US006814788B2

(12) United States Patent
Barazza et al.

(10) Patent No.: US 6,814,788 B2
(45) Date of Patent: Nov. 9, 2004

(54) VACUUM CLEANER WITH WATER FILTER

(75) Inventors: Gino Barazza, Conegliano (IT); Claudio Mezzalira, Altivole (IT)

(73) Assignee: EKO S.p.A., Susegana (IT)

( * ) Notice: Subject to any disclaimer, the term of this patent is extended or adjusted under 35 U.S.C. 154(b) by 327 days.

(21) Appl. No.: 10/140,366

(22) Filed: May 8, 2002

(65) Prior Publication Data

US 2002/0178537 A1 Dec. 5, 2002

(30) Foreign Application Priority Data

May 8, 2001 (IT) ..... VR2001A0055

(51) Int. Cl.[7] ..... B01D 47/06

(52) U.S. Cl. ..... 96/277; 96/361; 15/353; 261/116; 261/118

(58) Field of Search ..... 15/353; 96/355, 96/361, 277; 261/116, 118

(56) References Cited

U.S. PATENT DOCUMENTS 2,387,473 A * 10/1945 Spitzka ..... 96/233
3,686,833 A * 8/1972 Rush ..... 96/239
3,707,067 A * 12/1972 Dietrick ..... 96/241
4,078,908 A * 3/1978 Blackman ..... 96/309
5,041,274 A * 8/1991 Kagi, Sr. ..... 423/243.06
5,354,347 A * 10/1994 McCoy et al. ..... 96/330
5,512,072 A * 4/1996 Laslo ..... 96/234
5,752,997 A * 5/1998 Roth ..... 96/342
6,267,804 B1 * 7/2001 Marlowe ..... 96/237
6,350,302 B1 * 2/2002 Hallstead, Sr. ..... 96/240
6,562,304 B1 * 5/2003 Mizrahi ..... 422/171

* cited by examiner

*Primary Examiner*—Terrence R. Till
(74) *Attorney, Agent, or Firm*—Browdy and Neimark, P.L.L.C.

(57) ABSTRACT

Vacuum cleaner with water filter constituted by an aspirator connected to an air inlet conduit controllable by an operator, and by a filtering chamber interposed between the conduit and the aspirator. The filtering chamber has in its own lower portion a tank for containing the water and dirt. Above the maximum level of filling of the containment tank the filtering chamber also has a first air inlet section connected to the inlet conduit, and an air outlet section connected to the aspirator. The filtering chamber further comprise at least a second air inlet section. The aspirator is also provided with first means for spraying the water contained in the containment tank towards the main path of the air that goes from the first inlet section to the outlet section, associated to the first inlet section, and second means for spraying the water contained in the containment onto the air flowing along the main path, and operatively connected to the second inlet section.

17 Claims, 2 Drawing Sheets

VACUUM CLEANER WITH WATER FILTER

BACKGROUND OF THE INVENTION

The present invention relates to a vacuum cleaner with water filter of the type comprising the characteristics expressed in the preamble to claim 1.

In the sector of vacuum cleaners, over the past few years, vacuum cleaners characterized by their comprising a so-called water filter instead of traditional filters have become widespread.

Said vacuum cleaners are provided with a filtering chamber in which the flow of air aspirated by the vacuum cleaner is washed with a jet of water.

The chamber comprises inferiorly a containment tank which is filled with water, and above the tank an air inlet section, connected to the aspiration conduit, and an outlet section in turn connected to the aspirator.

In correspondence with the inlet section the air flow passes through a venturi-shaped tube portion, into which also ends a conduit in communication with the containment tank.

In this way, at steady state, the flow of air passing through the venturi creates a vacuum that causes the suction of water from the containment tank.

Said water hits the flow of air, capturing the particles of dirt suspended therein.

To facilitate the fall of the water back into the tank, bulkheads may also be provided inside the tank itself, whereon water can condense more easily.

Vacuum cleaners built in accordance with the prior art described above have at least one major drawback.

Whilst they do guarantee an excellent air filtering action when they function at steady state, the same cannot be said during transitory phases.

The term "transitory phases" means all those situations in which, while the vacuum cleaner is in use, the flow of air is interrupted as a result of an occlusion of the intake conduit, to be resumed after an interval.

It is common knowledge that it is extremely easy to occlude the intake conduit, for instance by excessively pressing its inlet against the surface to be cleaned, or by aspirating a piece of paper or a rag.

Each interruption of the flow of air, however, causes a consequent interruption of the water jet because the suction effect provided by the venturi is no longer available.

In this way, when the aspiration resumes, for a few moments the jet remains inactive and the dirty air passes beyond the filtering chamber without being appropriately filtered.

SUMMARY OF THE INVENTION

In this situation the technical task constituting the basis for the present invention is to provide a vacuum cleaner with water filter that overcomes the aforementioned drawbacks.

In particular, a technical task of the present invention is to provide a vacuum cleaner with water filter that assures a constant filtering of the air even if the flow of air through the aspiration conduit is accidentally interrupted.

Another technical task of the present invention is to provide a vacuum cleaner with water filter that is usable also within a washing-drying machine, in combination with a steam generator.

The specified technical task and the indicated aims are substantially achieved by a vacuum cleaner with water filter, as described in the accompanying claims.

BRIEF DESCRIPTION OF THE DRAWINGS

Further features and advantages of the invention shall become more readily apparent from the detailed description that follows of a preferred, but not exclusive embodiment of a vacuum cleaner with water filter, illustrated in the accompanying drawings, in which.

DESCRIPTION OF THE PREFERRED EMBODIMENTS

Figure 1:
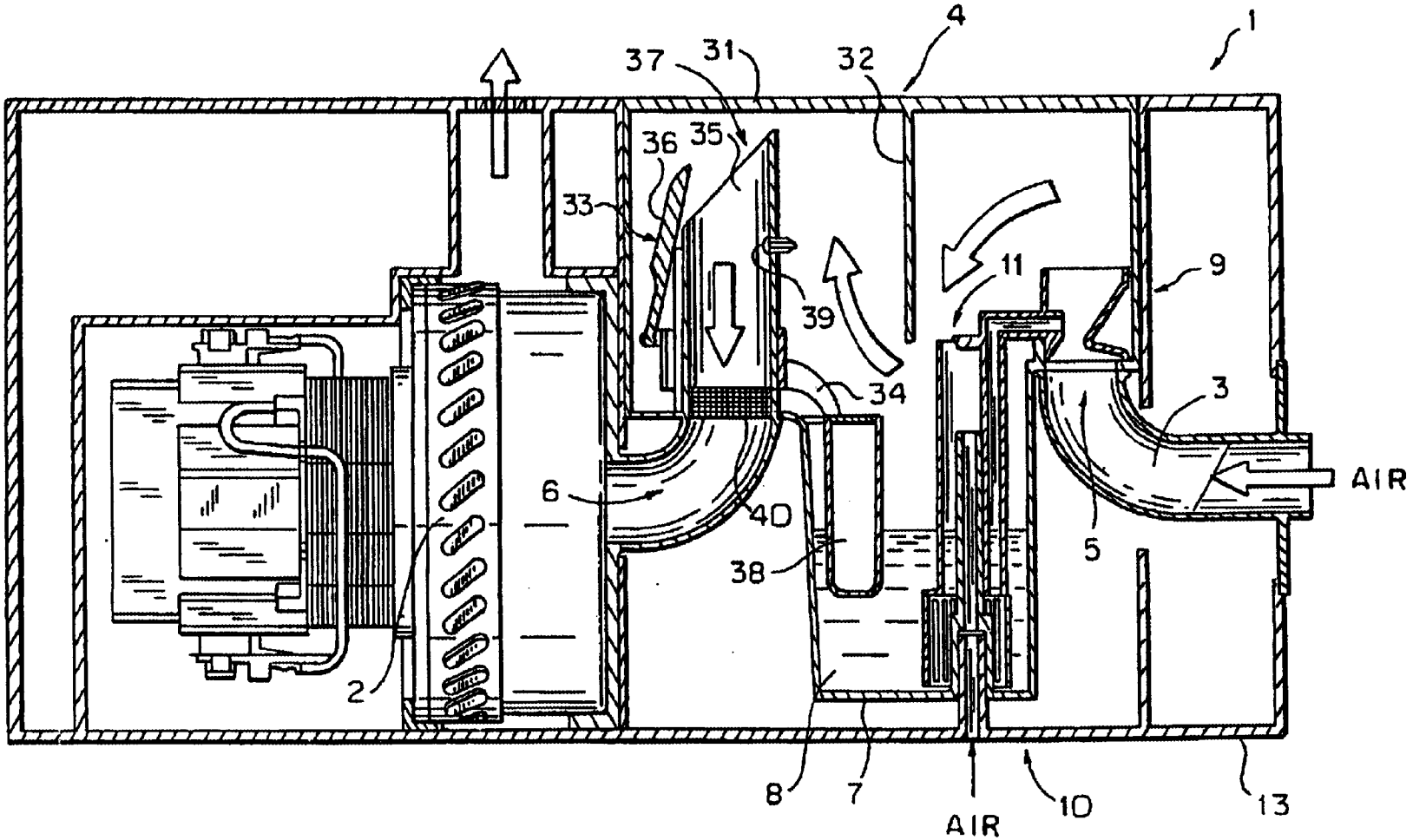
FIG. 1 shows a partially section lateral schematic view with some parts removed the better to highlight others of a vacuum cleaner with water filter according to the present invention.
Figure 2:
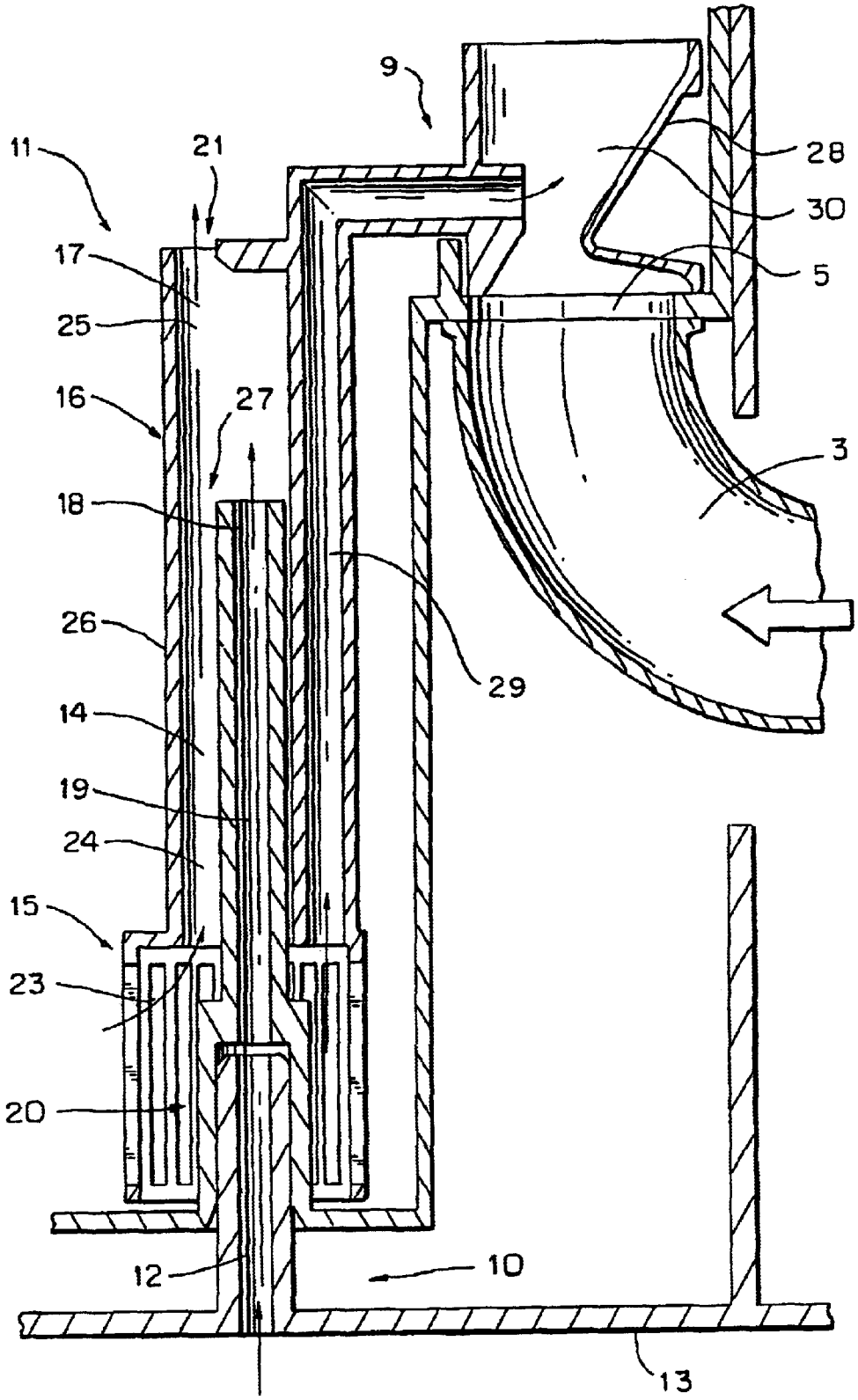
FIG. 2 shows an enlarged detail of the vacuum cleaner of FIG. 1.

With reference to the accompanying figures, the reference number 1 globally indicates a vacuum cleaner with water filter according to the present invention.

The vacuum cleaner 1 comprises an aspirator 2 operatively active on an air inlet conduit 3 controllable by an operator.

Between the aspirator 2 and the conduit 3 is provided an air filtering chamber 4.

Said air filtering chamber 4 has at least a first air inlet section 5 connected to the conduit 3, and an air outlet section 6 connected to the aspirator 2.

In a first lower portion 7 the filtering chamber 4 also has a tank 8 for containing water and dirt, whose maximum filling level is below both the first inlet section 5 and the outlet section 6.

Inside the filtering chamber 4 is identified a main path for the air, which extends from the first inlet section 5 to the outlet section 6.

The vacuum cleaner 1 further comprises first means 9 for spraying the water contained in the containment tank 8 on the flow of air, located along the main path of the air (in the illustrated embodiment, in correspondence with the first inlet section 5).

The filtering chamber further comprises at least a second inlet section 10 for the air whereto are associated second spraying means 11.

In the illustrated embodiment, the second inlet section 10 is in communication with the exterior through an opening 12 obtained in the outer case 13 of the vacuum cleaner 1.

The second spraying means 11 spray the water contained in the containment tank 8 on the air flowing along the main path when, during utilization, aspiration through the air conduit 3 is interrupted.

Said second spraying means 11 comprise a first conduit 14 having a lower end 15 inserted in the containment tank 8 and in communication with the containment tank 8 itself, and an upper end 16 in communication with a mixing chamber 17 positioned above the top level of the containment tank 8.

Into the mixing chamber 17 also ends a second extremity 18 of a second conduit 19 whose first extremity 20 is connected to the second inlet section 10.

The mixing chamber 17 further comprises a spray section 21 oriented towards the main path of the air, in correspondence with an intermediate portion of the path itself.

The dimensioning of the first conduit 14, of the second conduit 19 and of the mixing chamber 17 must be such that, at steady state, the flow of air entering from the second inlet section 10 is negligible relative to the flow of air entering from the first inlet section 5.

This implies that the cross section of the second conduit 19 must be smaller than that of the air inlet conduit 3.

A filter 23 is provided between the containment tank 8 and the lower end 15 of the first conduit 14, in order to avoid the aspiration into the first conduit 14 of the dirt present in the water contained in the containment tank 8.

In the embodiment illustrated in the accompanying figures, the first conduit 14 and the mixing chamber 17 are constituted respectively by a first and by a second portion 24, 25 of a same tube 26.

In the first portion 24 of the tube 26 itself is also inserted the second conduit 19 whose second extremity 18 is located in correspondence with the transition area 27 between the first and the second portion 24, 25 of the tube 26.

In other embodiments, the mixing chamber 17 can be constituted by a venturi conduit (similarly to the first spraying means 9 described below.

In regard to the first spraying means 9, in the preferred embodiment they comprise a venturi tube 28 positioned in correspondence with the first inlet section 5.

A third conduit 29 is connected between the containment tank 8 and the vacuum area 30 of the venturi tube 28. Between the third conduit 29 and the containment tank 8, the same filter 23 which is interposed between the first conduit 14 and the containment tank 8, is interposed, in order to avoid the suction in the third conduit 29 of the dirt present in the water contained in the containment tank 8.

In order to access inside the filtering chamber 4, both to supply clean water and to eliminate dirty water, the filtering chamber 4 itself is provided with a removable upper lid 31, which internally has a bulkhead 32 for condensing the water present in the flow of air.

In order to prevent water from exiting from the filtering chamber 4 towards the aspirator 2, a device 33 for shutting off the outlet section 6 is provided, which is automatically activated when the containment tank 8 is filled beyond the maximum allowed level.

Said shut-off device 33 is constituted by a rigid structure 34 mounted in sliding fashion on a substantially vertical fourth conduit 35 extending from the outlet section 6 towards the interior of the filtering chamber 4.

On the rigid structure 34 are mounted an element 36 for closing the free end 37 of the fourth conduit 35, and a float 38 inserted in the containment tank 8.

The travel of the rigid structure 34 along the fourth conduit is limited by an end stop 39.

A filter 40 mounted in the fourth conduit 35 prevents the aspiration towards the aspirator 2 of any water droplets still in suspension in the flow of air.

The vacuum cleaner described above can indifferently constitute either an independent aspirating unit, or constitute the aspirating part of washing and drying machines, in which case it can be associated to a steam generator, in a manner wholly similar to vacuum cleaners built according to traditional types.

The operation of the vacuum cleaner 1 with water filter, described thus far from the structural viewpoint, is as follows.

During operation, the aspirator 2 causes air to be drawn into the filtering chamber 4 through the two inlet sections.

In steady state operation, given the different size of the two inlet sections, the flow of air entering from the first inlet section 5 has a far greater flow rate than the flow of air entering from the second inlet section 10.

The passage of air in the venturi conduit causes the water contained inside the containment tank 8 to be drawn into the venturi conduit itself through the third conduit 29.

When the user causes the obstruction of the air conduit 3, the flow of air through the first inlet section 5 is stopped, whilst the flow of air through the second inlet section 10 remains active.

The passage of air in the mixing chamber 17 causes, due to the pressure differences that are created, water to be drawn towards the first conduit 14. Said water is sprayed towards the main path of the air.

When the flow of air through the conduit 3 and the first inlet section 5 is restored, the filtering of the dirt in the transitory phase is assured by the water sprayed by the spraying section 21 of the mixing chamber 17.

The present invention achieves important advantages.

In the first place the vacuum cleaner 1 with water filter of the present invention assures a constant filtration of the air even if the flow of air through the aspiration conduit is interrupted.

Moreover, said vacuum cleaner is usable either by itself or combined with a steam generator inside a washing-drying machine.

It should also be noted that the present invention is relatively easy to implement and that also the cost connected to the implementation of the invention is not very high.

The invention thus conceived can be subject to numerous modifications and variations, without thereby departing from the scope of the inventive concept that characterizes it.

All components can be replaced by other technically equivalent elements and in practice all materials used, as well as the shapes and dimensions of the various components, can be any depending on requirements.

What is claimed is:

1. Vacuum cleaner with water filter comprising an aspirator;

a filtering chamber having at least a tank for containing the water and the dirt located in a lower portion of said chamber, a first air inlet section and at least an air outlet section, said aspirator being operatively connected to said air outlet section, inside said filtering chamber being identified a main path for the air developing from said first inlet section to said outlet section;

an air inlet conduit associated to said first inlet section; and first means for spraying the water contained in said containment tank onto the flow of air, located along said main path of the air;

wherein said filtering chamber further comprises at least a second air inlet section, and second means for spraying the water contained in said containment tank on the air flowing along said main path, operatively connected to said second inlet section.

2. Vacuum cleaner as claimed in claim 1 wherein said second spraying means comprise a first conduit having a lower end inserted in said containment tank and in communication with said containment tank, and an upper end positioned above said containment tank;

a second conduit having a first end connected to said second inlet section and a second end positioned above said containment tank; and a mixing chamber connected to said second ends of the first and of the second conduit, and having a spraying section oriented towards the main path of the air.

3. Vacuum cleaner as claimed in claim 2 wherein said second conduit has smaller section than said air inlet conduit.

4. Vacuum cleaner as claimed in claim 2 wherein said second spraying means (11) further comprise a dirt filter positioned between said containment tank and said lower end of said first conduit.

5. Vacuum cleaner as claimed in claim 4 further comprising automatic means for shutting off said outlet section to prevent the exit of water from said containment tank towards the aspirator if the level of the water in the containment tank exceeds the maximum level allowed.

6. Vacuum cleaner as claimed in claim 4 wherein said first spraying means comprise a venturi tube positioned in correspondence with said first inlet section, and operatively connected to said first inlet section and to said containment tank.

7. Vacuum cleaner as claimed in claim 6 further comprising automatic means for shutting off said outlet section to prevent the exit of water from said containment tank towards the aspirator if the level of the water in the containment tank exceeds the maximum level allowed.

8. Vacuum cleaner as claimed in claim 2 wherein said second spraying means comprise a tube having a lower portion constituting said first conduit, and an upper portion constituting said mixing chamber, at least said second end of the second conduit being positioned internally to said tube in correspondence with the transition area between the first and the second portion.

9. Vacuum cleaner as claimed in claim 8 further comprising automatic means for shutting off said outlet section to prevent the exit of water from said containment tank towards the aspirator if the level of the water in the containment tank exceeds the maximum level allowed.

10. Vacuum cleaner as claimed in claim 8 wherein said first spraying means comprise a venturi tube positioned in correspondence with said first inlet section, and operatively connected to said first inlet section and to said containment tank.

11. Vacuum cleaner as claimed in claim 10 further comprising automatic means for shutting off said outlet section to prevent the exit of water from said containment tank towards the aspirator if the level of the water in the containment tank exceeds the maximum level allowed.

12. Vacuum cleaner as claimed in claim 2 wherein said first spraying means comprise a venturi tube positioned in correspondence with said first inlet section, and operatively connected to said first inlet section and to said containment tank.

13. Vacuum cleaner as claimed in claim 12 further comprising automatic means for shutting off said outlet section to prevent the exit of water from said containment tank towards the aspirator if the level of the water in the containment tank exceeds the maximum level allowed.

14. Vacuum cleaner as claimed in claim 2 further comprising automatic means for shutting off said outlet section to prevent the exit of water from said containment tank towards the aspirator if the level of the water in the containment tank exceeds the maximum level allowed.

15. Vacuum cleaner as claimed in claim 1 wherein said first spraying means comprise a venturi tube positioned in correspondence with said first inlet section, and operatively connected to said first inlet section and to said containment tank.

16. Vacuum cleaner as claimed in claim 15 further comprising automatic means for shutting off said outlet section to prevent the exit of water from said containment tank towards the aspirator if the level of the water in the containment tank exceeds the maximum level allowed.

17. Vacuum cleaner as claimed in claim 1 further comprising automatic means for shutting off said outlet section to prevent the exit of water from said containment tank towards the aspirator if the level of the water in the containment tank exceeds the maximum level allowed.

* * * * *